US010170266B2

(12) United States Patent
Lee

(10) Patent No.: US 10,170,266 B2
(45) Date of Patent: Jan. 1, 2019

(54) WIRE-WOUND FUSE RESISTOR AND METHOD FOR MANUFACTURING SAME

(71) Applicant: FIRST RESISTOR & CONDENSER CO., LTD., Taipei (TW)

(72) Inventor: Shang-Yo Lee, Taipei (TW)

(73) Assignee: FIRST RESISTOR & CONDENSER CO., LTD., Taipei (TW)

( * ) Notice: Subject to any disclaimer, the term of this patent is extended or adjusted under 35 U.S.C. 154(b) by 0 days.

(21) Appl. No.: 15/958,135

(22) Filed: Apr. 20, 2018

(65) Prior Publication Data

US 2018/0254163 A1 Sep. 6, 2018

Related U.S. Application Data

(63) Continuation-in-part of application No. 15/108,570, filed as application No. PCT/CN2014/070761 on Jan. 7, 2014, now Pat. No. 9,978,483.

(30) Foreign Application Priority Data

Jun. 29, 2017 (WO) ..... PCT/CN2017/090733

(51) Int. Cl.

| | |
|---|---|
| ***H01C 1/14*** | (2006.01) |
| ***H01H 85/048*** | (2006.01) |
| ***H01H 85/02*** | (2006.01) |
| ***H01C 17/04*** | (2006.01) |
| ***H01H 69/02*** | (2006.01) |
| ***H01C 3/20*** | (2006.01) |

(52) U.S. Cl.

CPC ..... *H01H 85/048* (2013.01); *H01C 1/14* (2013.01); *H01C 3/20* (2013.01); *H01C 17/04* (2013.01); *H01H 69/02* (2013.01); *H01H 85/0241* (2013.01)

(58) Field of Classification Search

CPC . H01C 1/14; H01C 3/20; H01C 17/04; H01H 85/048; H01H 85/0241

See application file for complete search history.

(56) References Cited

U.S. PATENT DOCUMENTS 4,044,326 A * 8/1977 Rodrigues ..... H01H 69/02 337/248
5,844,761 A * 12/1998 Place, IV ..... H01H 85/048 361/104
6,614,340 B2 * 9/2003 Handcock ..... H01H 85/055 337/162
9,240,300 B2 * 1/2016 Xu ..... H01C 1/14

(Continued)

*Primary Examiner* — Kyung S Lee
(74) *Attorney, Agent, or Firm* — Hannah M. Tien

(57) ABSTRACT

The present invention relates to a wire-wound fuse resistor, which has: an insulating rod which has a first end and a second end; one metal wire having a wire head and a wire tail, being helically wound around the insulating rod from the first end to the second end, and being cut at a middle portion thereof to form a first winding wire and a second winding wire, which are separated from each other; a connection part disposed at the cut portion for electrical connection between the first winding wire and the second winding wire, in which the melting temperature of the connection part is lower than that of the one wound metal wire, wherein the connection part is cut off depending on a predetermined melting temperature or melting speed of the wire-wound fuse resistor.

16 Claims, 16 Drawing Sheets

(56) References Cited

U.S. PATENT DOCUMENTS

| | | | | |
|---|---|---|---|---|
| 9,530,545 | B2 * | 12/2016 | Xu | H01H 85/055 |
| 9,589,711 | B2 * | 3/2017 | Jung | H01C 17/02 |
| 9,978,483 | B2 * | 5/2018 | Lee | H01C 3/20 |
| 2002/0109574 | A1 * | 8/2002 | Handcock | H01H 85/055 337/292 |
| 2007/0236324 | A1 * | 10/2007 | Yoshikawa | H01H 37/765 337/401 |
| 2013/0293343 | A1 * | 11/2013 | Xu | H01C 1/14 338/269 |
| 2016/0086757 | A1 * | 3/2016 | Xu | H01H 85/055 337/183 |

* cited by examiner

WIRE-WOUND FUSE RESISTOR AND METHOD FOR MANUFACTURING SAME

CROSS REFERENCE TO RELATED APPLICATIONS

This application is a Continuation-in-Part application of the pending U.S. patent application Ser. No. 15/108,570 filed on Jun. 27, 2016 which is a U.S. National Stage Application of PCT/CN2014/070761 filed Jan. 17, 2014, all of which is hereby incorporated by reference in their entirety. This application also claims priority to PCT Patent Application No. PCT/CN2017/090733 filed on Jun. 29, 2017, which is also incorporated by reference in its entirety. Although incorporated by reference in their entirety, no arguments or disclaimers made in the parent application apply to this Continuation-in-Part application. Any disclaimer that may have occurred during the prosecution of the above-referenced application(s) is hereby expressly rescinded. Consequently, the Patent Office is asked to review the new set of claims in view of the entire prior art of record and any search that the Office deems appropriate.

FIELD OF THE INVENTION

The invention relates to a surge-resistant wire-wound resistor and a manufacturing method thereof, especially a wire-wound resistor whose soldering points, at which a cap is soldered at each end of the resistor, are electroplated to form an electroplated metal layer to significantly improve the reliability of soldering points. The present invention further relates to an anti-surge wire-wound, low temperature fuse resistor and a manufacturing method thereof, in which the winding wire is cut off in a middle portion and electrically connected via a connection part.

BACKGROUND OF THE INVENTION

The structure of a conventional wire-wound resistor is shown in FIG. 1 and FIG. 2. In FIG. 2, the wire-wound resistor 10 comprises a ceramic rod 11, wherein the right end and left end of the ceramic rod 11 are respectively connected to a first iron cap 121 at the right end and a second iron cap 122 at the left end, and a wound metal wire 13, which is helically wound around the ceramic rod 11 along the circumference of the ceramic rod 11 from a wire head 131 on the first iron cap 121 to a wire tail 132 on the second iron cap 122, the wire head 131 of the wound metal wire 13 is subsequently soldered and fixed onto a wire-head soldering point 1311 of the first iron cap 121 by an electric soldering machine, and the wire tail 132 of the wound metal wire 13 is soldered and fixed on a wire-tail soldering point 1321 of the second iron cap 122, and then a first lead wire 141 and a second lead wire 142 extend respectively from the right of the first iron cap 121 and the left of the second iron cap 122 to form a conventional wire-wound resistor.

A wire-wound resistor is not the mainstream as to conventional surge-resistant resistors. When the transient energy of a surge wave is more than 100 watts, the surge loosens a certain proportion of the wound wires at the soldering points, which affects the surge resistance. In other words, for a conventional wire-wound resistor, when a wire head or a wire tail is soldered onto an iron cap obliquely or the soldering penetrates too deeply or not deep enough (as shown in FIG. 1, the wire tail 932 of the wound wire 93 is soldered obliquely at the soldering point 9321 of the second iron cap 922 on the ceramic rod 91), the contact resistance between the soldering point and the iron cap increases because the soldering points are soldered poorly (for example a soldering machine). Therefore, a surge event may loosen the soldering points and a certain failure rate of the soldering points of a wire-wound resistor may ensue. The failure rate of the surge-resistant soldering points of a conventional wire-wound resistor is approximately 10 ppm. Because the failure rate of the aforementioned surge-resistant soldering points is still high, the wire-wound resistor industry is eagerly looking for a surge-resistant wire-wound resistor which has highly reliable surge-resistant soldering points.

Further, when a circuit is operated normally, a fuse resistor performs as a fixed resistor. While working current exceeds rated current, the resistor blows due to overheating so as to protect the circuit. In general, a fusing temperature of a wire wound fuse resistor is a melting point of its wire. However, based on considering resistance and other electrical properties, the wire material of the conventional fuse resistor is essentially made of an alloy with a high melting point. The fusing temperature of the wire is too high, and there is a procedure of glowing red. The procedure of glowing red may burn and destroy circuits and other components, and thus the effect of circuit protection is affected.

Owing to the aforementioned drawbacks of prior arts, the present invention provides a highly reliable wire-wound resistor to decrease the failure rate of the surge- resistant soldering points and to improve the surge-resistance reliability and further provides a highly reliable wire-wound fuse resistor to protect the circuits and/or other components safely.

SUMMARY OF THE INVENTION

According to the first embodiment of the present invention, the main purpose of the present invention is to provide a surge-resistant wire-wound resistor, comprising:

a ceramic rod which has a first end and a second end;

one or more than one wound metal wire which has a wire head and a wire tail and is helically wound around the ceramic rod from the first end to the second end;

a first cap and a second cap which are respectively disposed along an axis of the ceramic rod and extending outwardly from the first end and the second end, wherein the wire head and the wire tail are respectively soldered on the surfaces of the first cap and the second cap at the first cap and the second cap, and the first cap and the second cap are respectively electroplated with a first cap electroplated layer and a second cap electroplated layer; and a first insulating layer which is disposed on the surface of the ceramic rod and covers the surfaces of the ceramic rod and the wound metal wire.

According to the second embodiment of the present invention, the surge-resistant wire-wound resistor of the present invention further comprises a first lead wire and a second lead wire which are respectively disposed along an axial axis of the ceramic rod and extending outwardly from the first cap and the second cap.

According to the second embodiment of the present invention, the surge-resistant wire-wound resistor of the present invention further comprises a second insulating layer which is disposed on and covers the surface of the first insulating layer and the surfaces of the first cap electroplated layer and the second cap electroplated layer.

According to the present invention, preferably, the first cap electroplated layer is selected from the group consisting of, but not limited to, tin, copper, iron, silver, nickel and alloys thereof.

According to the present invention, preferably, the thickness of the first cap electroplated layer is from 1 μm to 10 μm.

According to the present invention, preferably, the second cap electroplated layer is selected from the group consisting of, but not limited to, tin, copper, iron, silver, nickel and alloys thereof.

According to the present invention, preferably, the thickness of the second cap electroplated layer is from 1 μm to 10 μm.

According to the present invention, preferably, the material of the first insulating layer is epoxy resin.

According to the present invention, preferably, the material of the second insulating layer is epoxy resin, nonflammable silicone paint or enamel paint.

According to the first embodiment of the present invention, another purpose of the present invention is to provide a manufacturing method for a surge-resistant wire-wound resistor, comprising the steps of:

providing a ceramic rod;

mounting a first cap and a second cap respectively on a first end and a second end of the ceramic rod;

winding a wound metal wire around the circumference of the ceramic rod;

soldering two ends of the wound metal wire on the first cap and the second cap;

coating a first insulating layer on surrounding of the ceramic rod; and electroplating respectively a cap electroplated layer on surfaces of the first cap and the second cap.

According to the second embodiment of the present invention, the manufacturing method of the present invention further comprises a step of: connecting a first lead wire and a second lead wire to an axially extended line of the ceramic rod and respectively extending the first lead wire and the second lead wire outwardly from the first cap and the second cap.

According to the second embodiment of the present invention, the manufacturing method of the present invention further comprises a step of: coating a second insulating layer on the surface of the first insulating layer and the surfaces of the first cap electroplated layer and the second cap electroplated layer.

Further, one aspect of the present invention provides an anti-surge wire-wound low temperature fuse resistor.

A wire-wound fuse resistor according to some embodiments of the present invention includes an insulating rod having a first end and a second end;

one metal wire having a wire head and a wire tail, being helically wound around the insulating rod from the first end to the second end, and being cut at a middle portion thereof to form a first winding wire connecting with the wire head and a second winding wire connecting with the wire tail, wherein the first winding wire and the second winding wire are separated from each other;

a connection part disposed at the cut portion for electrical connection between the first winding wire and the second winding wire, wherein the melting temperature of the connection part is lower than that of the first winding wire and the second winding wire; and a first cap and a second cap respectively disposed to encapsulate the first end and the second end, in which the wire head and the wire tail are respectively soldered onto surfaces of the first cap and the second cap at the first cap and the second cap, and the first cap and the second cap are respectively electroplated with a first cap electroplated layer and a second cap electroplated layer, wherein the first electroplated layer on the first cap, the second electroplated layer on the second cap and the connection part are formed in the same process, and wherein the connection part is cut off depending on a predetermined melting temperature or melting speed of the wire-wound fuse reistor.

In some embodiments, the wire-wound fuse resistor further includes a first insulating layer covering the first winding wire and the second winding wire, wherein the first insulating layer has an opening exposing a portion of the insulating rod.

In some embodiments, a material of the first insulating layer is an epoxy resin, a silicone non-flammable paint or an enamel paint.

In some embodiments, the opening includes a slot opening surrounding the insulating rod and partially exposing the insulating rod.

In some embodiments, the opening includes a dot opening partially exposing the insulating rod.

In some embodiments, the connection part is in contact with the first winding wire and the second winding wire through the opening of the first insulating layer.

In some embodiments, the fuse resistor further includes a second insulating layer covering the first insulating layer and the connection part, and filling into the opening of the first insulating layer.

In some embodiments, a material of the second insulating layer is an epoxy resin, a silicone non-flammable paint or an enamel paint.

In some embodiments, the wire-wound fuse resistor further includes a first cap and a second cap, wherein the first cap is electrically welded on an end of the first winding wire from the first end of the insulating rod, and the second cap is electrically welded on an end of the second winding wire from the second end of the insulating rod.

In some embodiments, material used for welding the first cap with the first end of the insulating rod, i.e. a first cap electroplated layer, and the second cap with the second end of the insulating rod, i.e. a second electroplated layer, is the tin, copper, iron, silver, nickel or an alloy thereof. And the thicknesses of the welding between 1 micrometer and 20 micrometers, respectively.

A method for fabricating a wire-wound fuse resistor according to some embodiments of the present invention includes the following steps: providing an insulating rod having a first end and a second end; winding a metal wire on the insulating rod; cutting off the metal wire to form a first winding wire and a second winding wire separated from each other; and forming a connection part for electrically connecting the first winding wire to the second winding wire, wherein the melting point of the connection part is lower than that of the first winding wire and the second winding wire.

In some embodiments, the method further includes: forming a first insulating layer on the insulating rod and the metal wire before cutting off the metal wire; and forming an opening in the first insulating layer and cutting off the wire.

In some embodiments, the opening includes a slot opening surrounding the insulating rod and partially exposing the insulating rod.

In some embodiments, the opening includes a dot opening partially exposing the insulating rod.

In some embodiments, the method further includes: forming a second insulating layer for covering the first insulating layer and the connection part and filling into the opening of the first insulating layer.

In some embodiments, the method further includes: encapsulating a first cap on a first end of the insulating rod, and encapsulating a second cap on a second end of the insulating rod.

In some embodiments, the method further includes: electrically welding one end of the metal wire on the first cap, and electrically welding the other end of the metal wire on the second cap.

In some embodiments, the method further includes: electrically connecting an end of the first winding wire to the first cap by using a first electroplated layer, and electrically connecting an end of the second winding wire to the second cap by using a second electroplated layer.

In some embodiments, the first electroplated layer, the second electroplated layer and the connection part are formed together by the same process.

According to the present invention, a wire-wound fuse resistor is provided, comprising: an insulating rod having a first end and a second end;

one metal wire having a wire head and a wire tail, being helically wound around the insulating rod from the first end to the second end, and being cut at a middle portion thereof to form a first winding wire connecting with the wire head and a second winding wire connecting with the wire tail, wherein the first winding wire and the second winding wire are separated from each other;

a connection part disposed at the cut portion for electrical connection between the first winding wire and the second winding wire, wherein the melting temperature of the connection part is lower than that of the first winding wire and the second wire; and a first cap and a second cap respectively disposed to encapsulate the first end and the second end, in which the wire head and the wire tail are respectively soldered onto surfaces of the first cap and the second cap at the first cap and the second cap, and the first cap and the second cap are respectively electroplated with a first cap electroplated layer and a second cap electroplated layer, wherein the first electroplated layer on the first cap, the second electroplated layer on the second cap and the connection part are formed in the same process, and wherein the connection part is cut off depending on a predetermined melting temperature or melting speed of the wire-wound fuse reistor.

EXAMPLES

Figure 1:
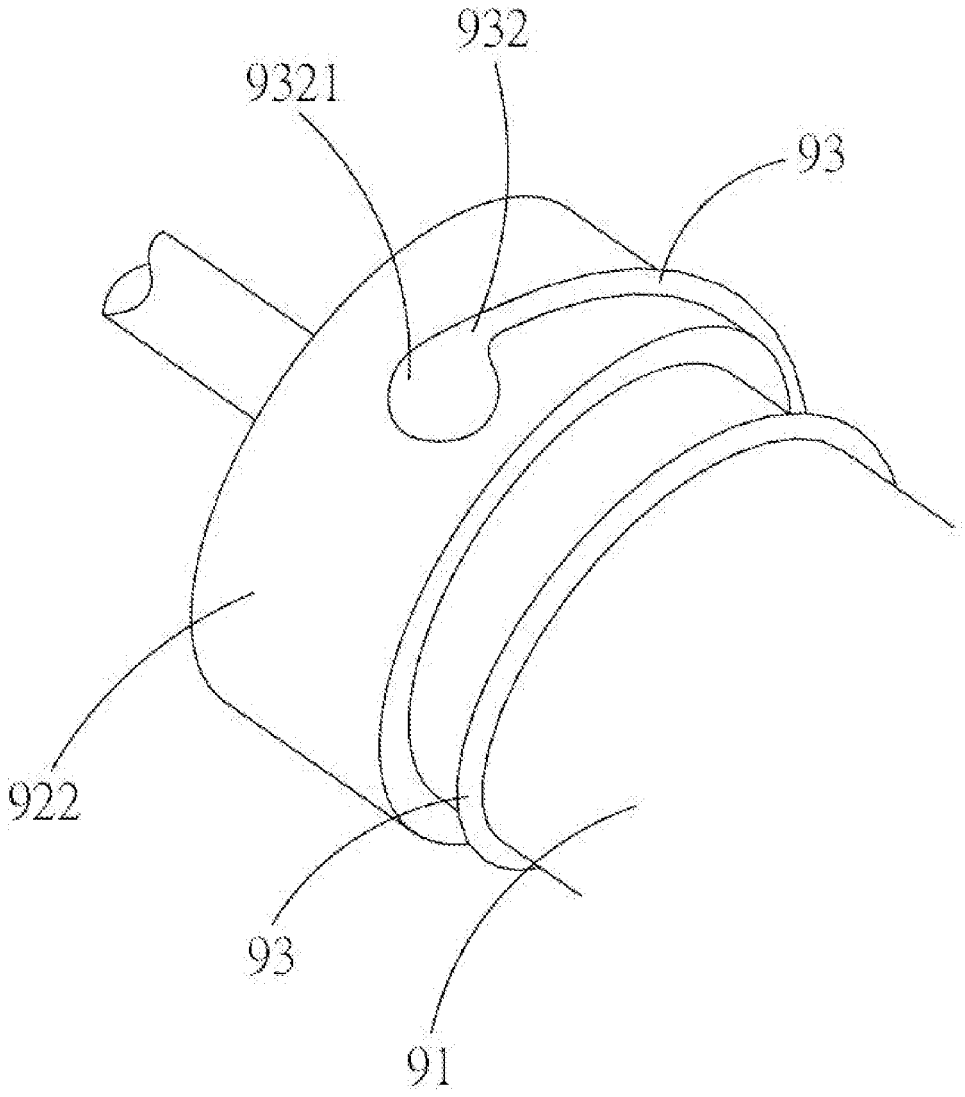
FIG. 1 is a schematic diagram showing that a conventional wire-wound resistor is soldered obliquely.
Figure 2:
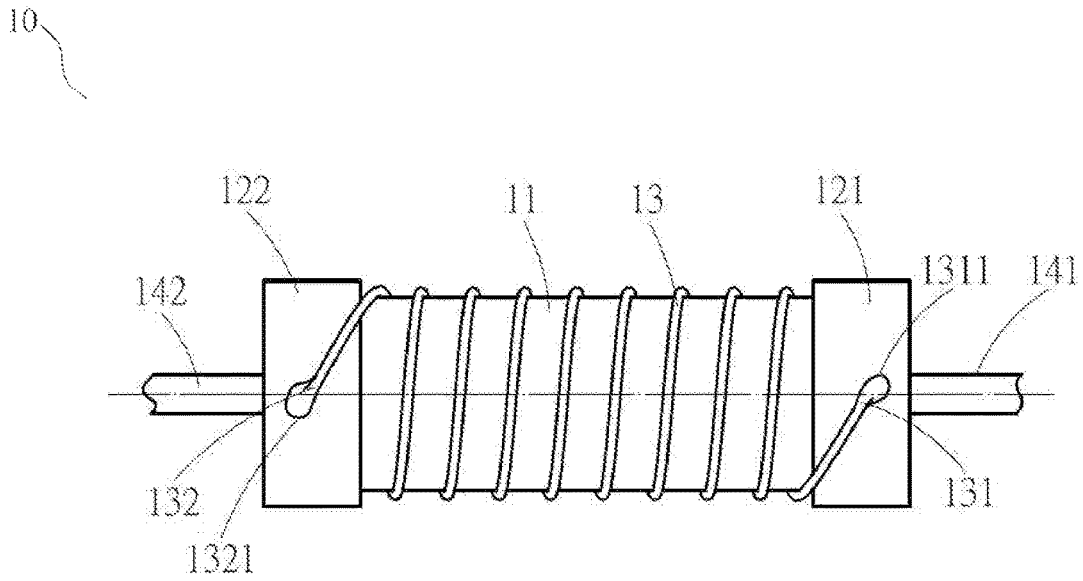
FIG. 2 is a side view diagram of a conventional wire-wound resistor.

As shown in FIG. 3A, FIG. 3B, FIG. 4A and FIG. 4B, according to the first example of the present invention (the MELF type of wire-wound resistor), the present invention provided a surge-resistant wire-wound resistor 20, comprising:

a ceramic rod 21 which had a first end 211 and a second end 212;

one or more than one wound metal wire 23 which had a wire head 231 and a wire tail 232 and was helically wound around the ceramic rod from the first end 211 to the second end 212;

a first cap 221 and a second cap 222 which were respectively disposed along an axis of the ceramic rod 21 and extending outwardly from the first end 211 and the second end 212, wherein the wire head 231 and the wire tail 232 were respectively soldered on the surfaces of the first cap 221 and the second cap 222 at the first cap 221 and the second cap 222, and the first cap 221 and the second cap 222 were respectively electroplated with a first cap electroplated layer 2211 on the surface of the first cap 221 and a second cap electroplated layer 2221 on the surface of the second cap 222; and a first insulating layer 2111 which was disposed on the surface of the ceramic rod 21 and covered the surfaces of the ceramic rod 21 and the wound metal wire 23.

According to the second example of the present invention (a type of the wire- wound resistor with winding wires), the present invention provided a surge-resistant wire-wound resistor 420, comprising:

a ceramic rod 421 which had a first end 4211 and a second end 4212;

one or more than one wound metal wire 423 which had a wire head 4231 and a wire tail 4232 and was helically wound around the ceramic rod 421 from the first end 4211 to the second end 4212;

a first cap 4221 and a second cap 4222 which were respectively disposed along an axis of the ceramic rod 421 and extending outwardly from the first end 4211 and the second end 4212, wherein the wire head 4231 and the wire tail 4232 were respectively soldered on the surfaces of the first cap 4221 and the second cap 4222 at the first cap 4221 and the second cap 4222, and the first cap 4221 and the second cap 4222 were respectively electroplated with a first cap electroplated layer 42211 on the surface of the first cap 4221 and a second cap electroplated layer 42221 on the surface of the second cap 4222;

a first insulating layer 42111 which was disposed on the surface of the ceramic rod 421 and covered the surfaces of the ceramic rod 421 and the wound metal wire 423;

a first lead wire 4241 and a second lead wire 4242 which were respectively disposed along an extended line of the axle center 4213 of the ceramic rod 421 and extending outwardly from the first cap 4221 and the second cap 4222; and a second insulating layer which was disposed on and covered the surface of the first insulating layer 42111 and the surfaces of the first cap 4221 and the second cap 4222.

The ceramic rod 21, 421 of the present invention was made of, but not limited to, insulating materials. Any insulating cylinders which could achieve the goal of the present invention could be used, for example, a white ceramic rod or a glass fiber cylinder.

The first cap 221, 4221 and the second cap 222, 4222 were mounted on two ends of the ceramic rod 21, 421. Materials of the first cap 221, 4221 and the second cap 222, 4222 could be, but not limited to, metals such as iron, steel, aluminum, copper, or other alloys or graphite materials. Any materials which could fulfill the function of the cap could be used.

Figure 3A:
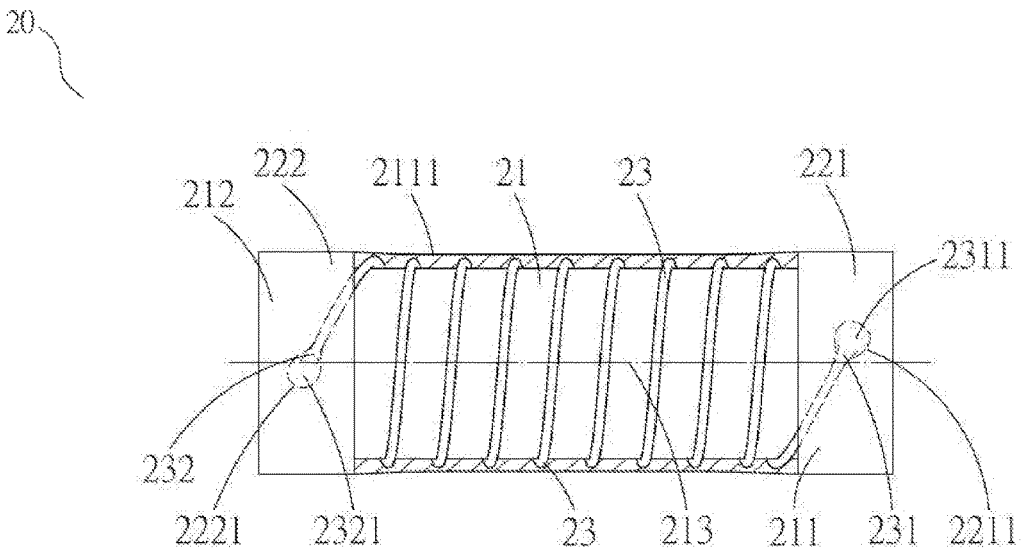
FIG. 3A is a side view diagram of the first embodiment of a wire-wound resistor of the present invention.
Figure 3B:
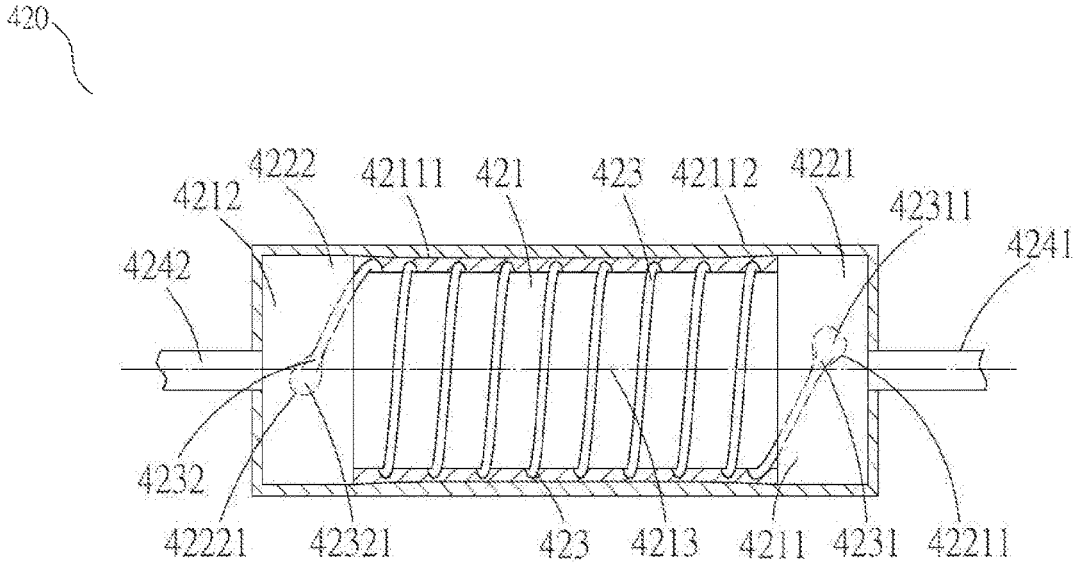
FIG. 3B is a side view diagram of the second embodiment of a wire-wound resistor of the present invention.

As shown in FIG. 3A and FIG. 3B, the wire head 231, 4231 was soldered onto the first cap 221, 4221 at a wire-head soldering point 2311, 42311; the wire tail 232, 4232 was soldered onto the second cap 222, 4222 at a wire-tail soldering point 2321, 42321.

Figure 4A:
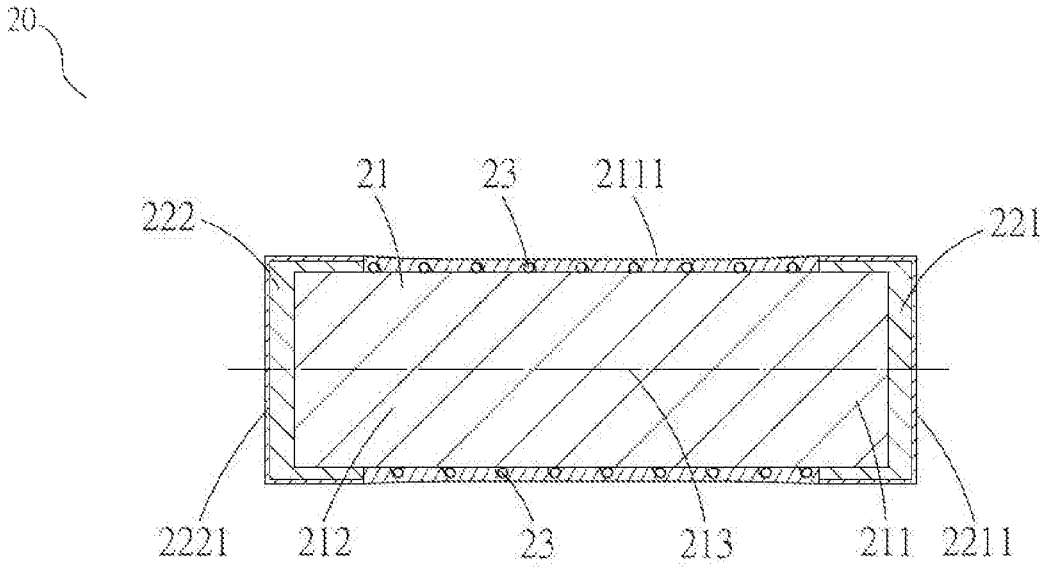
FIG. 4A is a diagram illustrating a cross section of the first embodiment of a wire- wound resistor of the present invention.
Figure 4B:
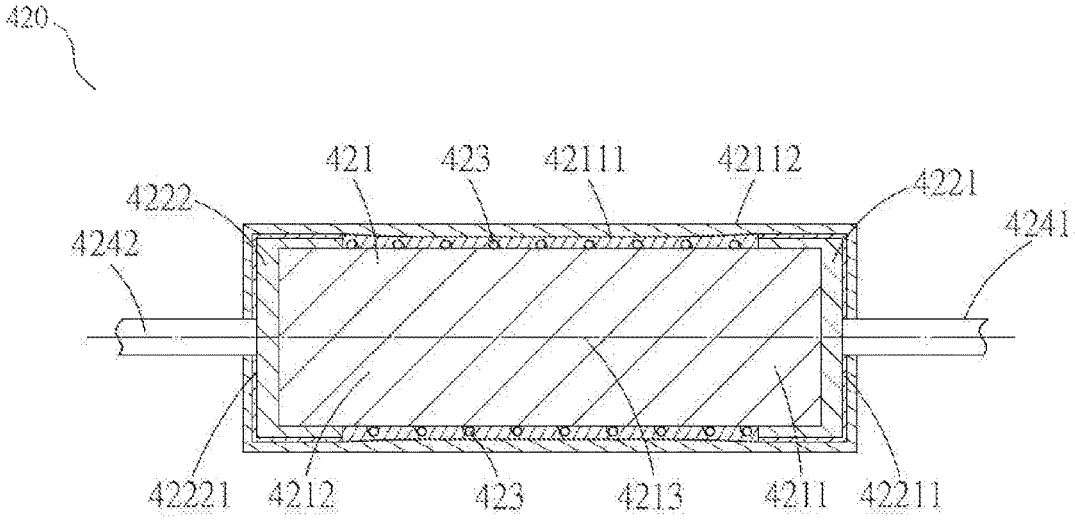
FIG. 4B is a diagram illustrating a cross section of the second embodiment of a wire-wound resistor of the present invention.

As shown in 4A and FIG. 4B, the first cap electroplated layer 2211, 42211 and the second cap electroplated layer 2221, 42221 of the present invention were respectively formed on the first cap 221, 4221 and the second cap 222, 4222 by using an industrial electroplating process, wherein the electroplated layer of the first cap electroplated layer 2211, 42211 and the second cap electroplated layer 2221, 42221 were in material selected from the group consisting of, but not limited to, tin, copper, iron, silver, nickel and alloys thereof.

Figure 5:
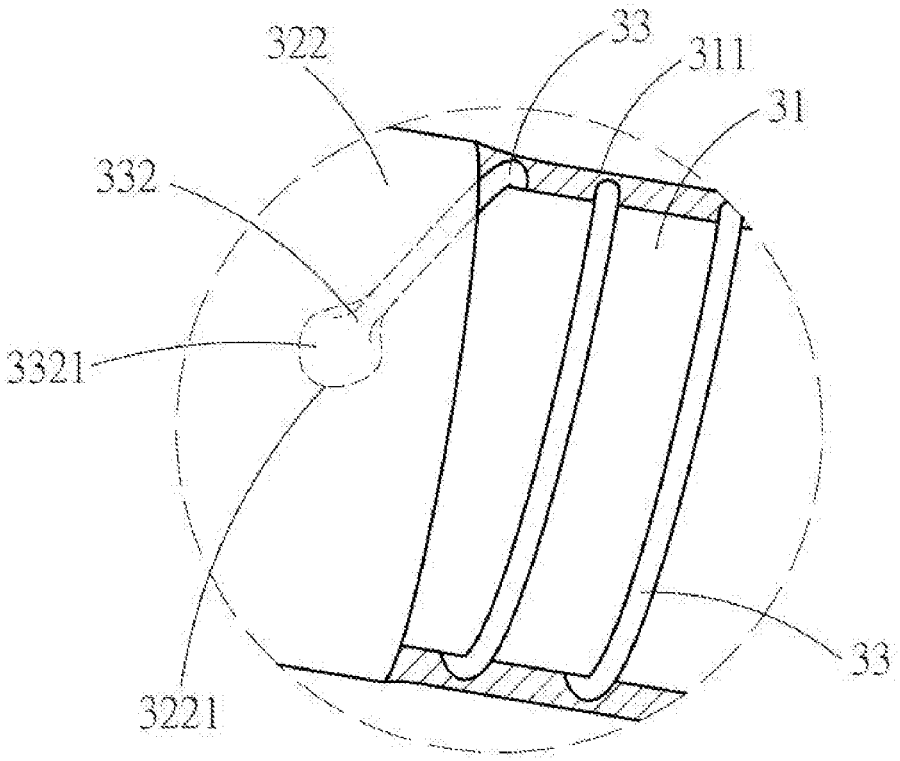
FIG. 5 is a schematic diagram showing a soldering point of a wire-wound resistor of the present invention.

As shown in FIG. 5, as to the wire-wound resistor of the present invention, the wire tail 332 of the wound metal wire 33 wound around the ceramic rod 31 was soldered onto the surface of the cap 322, and a cap electroplated layer 3221 was formed on the soldering point 3321.

As shown in FIG. 3A and FIG. 4A, according to the first example of the present invention, the present invention provided a manufacturing method for a surge-resistant wire-wound resistor, comprising the steps of:

providing a ceramic rod 21;

mounting a first cap 221 and a second cap 222 respectively on a first end 211 and a second end 212 of the ceramic rod 21;

winding a wound metal wire 23 around the circumference of the ceramic rod 21;

soldering two ends of the wound metal wire 23 onto the first cap 221 and the second cap 222;

coating a first insulating layer 2111 on surrounding of the ceramic rod 21; and electroplating surfaces of the first cap 221 and the second cap 222 to form a cap electroplated layer 2211 and a cap electroplated layer 2221, respectively.

As shown in FIG. 3B and FIG. 4B, according to the second example of the present invention, the present invention provided a manufacturing method for a surge-resistant wire-wound resistor, comprising:

providing a ceramic rod 421;

winding a wound metal wire 423 around the circumference of the ceramic rod 421;

mounting a first cap 4221 and a second cap 4222 respectively on a first end 4211 and a second end 4212 of the ceramic rod 421;

soldering two ends of the wound metal wire 423 onto the first cap 4221 and the second cap 4222;

coating a first insulating layer 42111 on surrounding of the ceramic rod;

electroplating surfaces of the first cap 4221 and the second cap 4222 respectively to form a cap electroplated layer 42211 and a cap electroplated layer 42221;

connecting a first lead wire 4241 and a second lead wire 4242 to an extended line of the axial center of the ceramic rod 421 and extending them outwardly from the first cap 4221 and the second cap 4222; and coating a second insulating layer 42112 on a surface of the first insulating layer 42111 and surfaces of the cap electroplated layer 42211 and the cap electroplated layer 42221.

In the present invention, because the first cap and the second cap were respectively electroplated to have a cap electroplated layer, the strength of the soldering points was increased, the failure rate was decreased, and the reliability of the soldering points was further improved. Therefore, the failure rate of the surge-resistant soldering point of the wire-wound resistor provided by the present invention was less than 0.1 ppm.

The wire-wound resistor provided by the present invention could be used not only in surge-resistant circuits, but also in spark plug covers for the motor vehicle and motorcycle industry and ignition systems for automobiles.

The structures and examples aforementioned are illustrated for fully realizing the present invention and should not be construed to limit the scope of the invention. One skilled in the art may modify and vary the examples without departing from the spirit and scope of the present invention.

The following disclosure provides many different embodiments, or examples, for implementing different features of the wire-wound fuse resistor. Specific examples of elements and arrangements are described below to simplify the present disclosure. These are, of course, merely examples and are not intended to be limiting. The present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath", "below", "lower", "above", "upper", "on" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Figure 6:
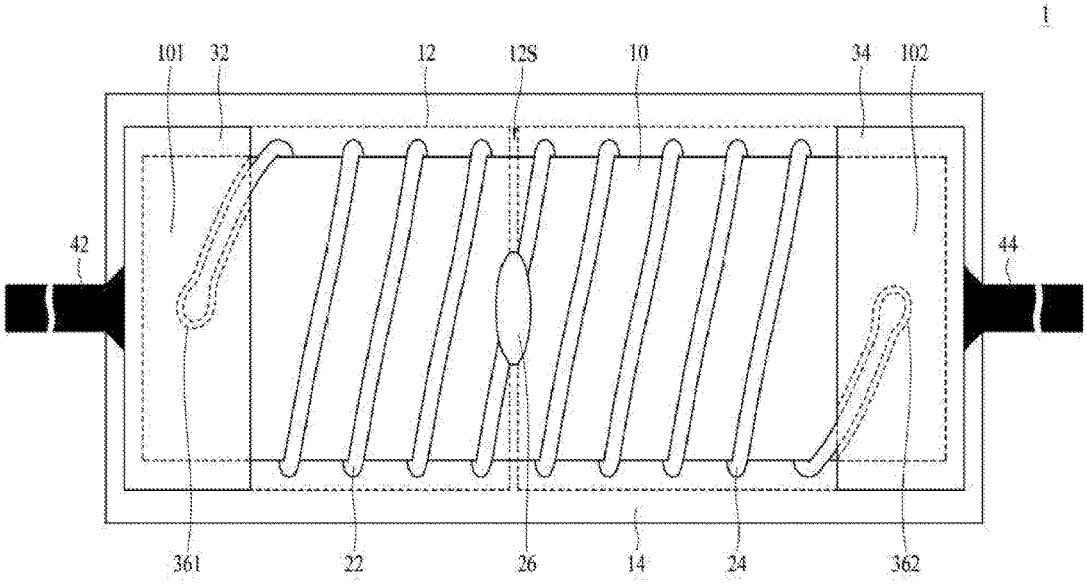
FIG. 6 is a schematic view showing a wire-wound fuse resistor in accordance with an embodiment of the present invention.

FIG. 6 is a schematic view showing a wire-wound fuse resistor in accordance with an embodiment of the present invention. As shown in FIG. 6, the wire-wound fuse resistor 1 of the present embodiment included an insulating rod 10, a first winding wire 22, a second winding wire 24 and a connection part 26. The insulating rod 10 had a first end 101 and a second end 102. In the present embodiment, the insulating rod 10 could include a ceramic rod, but the material of the insulating rod 10 was not limited to ceramic material, and any insulating material such as a glass fiber capable of achieving the purpose of the present invention could be used. In addition, in the present embodiment, the shape of the insulating rod 10 is, but not limited to, a cylindrical shape.

The insulating rod 10 was wound by the first winding wire 22 from a first end 101, and wound by the second winding wire 24 from a second end 102, wherein the first winding wire 22 and the second winding wire 24 were not directly connected but had a gap therebetween. In some embodiments, the insulating rod 10 was wound by one metal wire, including a wire head connecting with the first winding wire 22 and a wire tail connecting with the second winding wire 24, in a spiral -wound manner, in which the gap was formed by cutting the metal wire in a middle portion thereof to form the gap. In some embodiments, the gap between the first winding wire 22 and the second winding wire 24 was between about 0.05 mm and about 2 mm. The connection part 26 was disposed between the first winding wire 22 and the second winding wire 24, and had a length slightly more than the gap between the first winding wire 22 and the second winding wire 24 for connecting the first winding wire 22 and the second winding wire 24. The melting point of the connection part 26 is lower than the melting point of the first winding wire 22 and the second winding wire 24, and the first winding wire 22 and the second winding wire 24 were separated from each other and electrically connected via the connection part 26.

In the present embodiment, material of the first winding wire 22 and the second winding wire 24 could include or could be selected from the materials having higher melting point than the connection part 26. For example, the melting points of the first winding wire 22 and the second winding wire 24 were between about 800° C. and about 1500° C., and the melting point of the connection part 26 could be lower than about 500° C. or lower than 300° C., and could be lower than, but not limited to, about 200° C. to about 300° C. The materials of the first winding wire 22, the second winding wire 24 and the connection part 26 could be determined according to the electrical specification and the safety specification of the resistor. In some embodiments, the materials of the first winding wire 22 and the second winding wire 24 could include or could be selected from nickel-copper alloy or other suitable conductive metal or alloy materials with high melting points, and the material of the connection part 26 could include or could be selected from tin, copper, other connective metals or alloy materials with lower melting points. By the above configuration, when the working current of the wire-wound fuse resistor 2 in the present embodiment exceeded rated current, the connection part 26 having a lower melting point had a lower fusing temperature and a faster fusing speed, such that the connection part 26 would be fused first to protect the circuit. In addition, it was noted that under the normal operation, the operation temperature of the fuse resistor 1 was under about 70° C., and thus the connection part 26 having the lower melting point would not affect the normal operation of the fuse resistor 1.

Further, the connection part might be cut off depending on a predetermined melting temperature or melting speed of the wire-wound fuse resistor so as increase the application scope and enhance the safety.

In some embodiments, the wire-wound fuse resistor 1 could further include a first insulating layer 12 covering the first winding wire 22 and the second winding wire 24. The first insulating layer 12 had an opening 12S exposing a portion of the insulating rod 10. In some embodiments, the material of the first insulating layer 12 could include or could be selected from an insulating paint such as an epoxy resin, or other insulating materials. In some embodiments, the connection wire part 26 was in contact with the first winding wire 22 and the second winding wire 24 via the opening 12S of the first insulating layer 12. In some embodiments, the opening 12S of the first insulating layer 12 might include a slot opening, which surrounded the insulating rod 10 and partially exposed the insulating rod 10. In some embodiments, a width of the slot opening of the first insulating layer 12 was between, but not limited to, about 0.05 mm and 2 mm.

In some embodiments, the wire-wound fuse resistor 1 could further include a second insulating layer 14 covering the first insulating layer 12 and the connection layer 26, and filling the opening 12S of the first insulating layer 12. In some embodiments, the material of the second insulating layer 14 could include or could be selected from an insulating paint such as an epoxy resin, a silicone non-flammable paint, an enamel paint or other insulating materials.

In some embodiments, the fuse resistor 1 could further include a first cap 32 and a second cap 34. The first cap 32 encapsulated the first end 101 of the insulating rod 10 and was connected to the first winding wire 22, and the second cap 34 encapsulated the second end 102 of the insulating rod 10 and was connected to the second winding wire 24. In some embodiment, the materials of the first cap 32 and the second cap 34 might be iron, steel, aluminum, copper, other metals, an alloy or a graphite material. In some embodiments, one end of the first winding wire 22 could be welded firstly on the first cap 32, and one end of the second winding wire 24 could be welded firstly on the second cap 34. In some embodiments, the wire-wound fuse resistor 1 could further include a first cap electroplated layer 361 for electrically connecting one end of the first winding wire 22 to the first cap 32, and a second cap electroplated layer 362 for electrically connecting one end of the second winding wire 24 to the second cap 34. In some embodiments, the material of the first cap electroplated layer 361 and the second cap electroplated layer 362 could be, but not limited to, tin, copper, iron, silver, nickel or other alloys. In some embodiments, the first cap electroplated layer 361 and the second cap electroplated layer 362 could be formed by, but not limited to, electroplating. In some embodiments, the first cap electroplated layer 361, the second cap electroplated layer 362 and the connection part 26 were formed together by the same process to simplify the fabrication procedure. In some embodiments, the thicknesses of the first cap electroplated layer 361 and the second cap electroplated layer 362 were, but not limited to, between about 1 micrometer and about 20 micrometers, respectively. Under a surge shock situation, about more than 90% of occurrence that the conventional wire wound resistor breaks occurs at the solder point between the wire and the cap, resulting in an open circuit failure. Therefore, the first cap electroplated layer 361 and the second cap electroplated layer 362 were used respectively for reinforcing the welding portion of the first winding wire 22 and the second winding wire 24, so as to enhance firmness of the welding portion, reduce the production failure rate and even increase reliability of welding. The welding firmness of the first winding wire 22 and the second winding wire 24 were ensured by the first cap electroplated layer 361 and the second cap electroplated layer 362, such that the anti -surge effect of the wire-wound fuse resistor 1 were increased.

In some embodiments, the wire-wound fuse resistor 1 further included a first conductive line 42 extending outwards from the first cap 32 and electrically connected to the first cap 32, and a second conductive line 44 extending outwards from the second cap 34 and electrically connected to the second cap 34. The first conductive line 42 and the second conductive line 44 were electrically connected to an external circuit, for example, a printed circuit board.

Please refer to Table 1. The fusing test results of the wire-wound fuse resistors in comparative embodiments and embodiments of the present invention are listed in Table 1.

TABLE 1

| Test Sample | Resistance value | Times of fusing power/power | Fusing time | Fusing temperature |
|---|---|---|---|---|
| Fuse resistor in the comparative embodiment | 2 W/1 Ω ± 5% | 40 times/ 80 W | 15.63 s | 862.63° C. |
| Fuse resistor in the embodiment of the present disclosure | 2 W/1 Ω ± 5% | 40 times/ 80 W | 4.38 s | 353.31° C. |

In the fusing tests shown in Table 1, the fuse resistor in the comparative embodiment and the fuse resistor in the embodiment of the present invention had the same resistance value, i.e. 1Ω, and the same power, i.e. 2 W, wherein the first winding wire and the second winding wire of the fuse resistor in the comparative embodiment were directly connected, and the first winding wire and the second winding wire of the fuse resistor in the embodiment of the present invention were electrically connected via the connection part with a low melting point. For example, the material of the connection wire part was tin, and formed by electroplating. As shown in Table 1, the errors of the resistance values of the fuse resistors in the comparative embodiment and the embodiment of the present invention were both in an acceptable range (±5%), and in the condition that the fusing power was set as 40 times, the fusing time and the fusing temperature of the fuse resistor in the embodiment of the present invention were both lower than those of the fuse resistor in the comparative embodiments, proving that the fuse resistor in the embodiment of the present invention effectively enhances the protection effect to the circuit.

Figure 7:
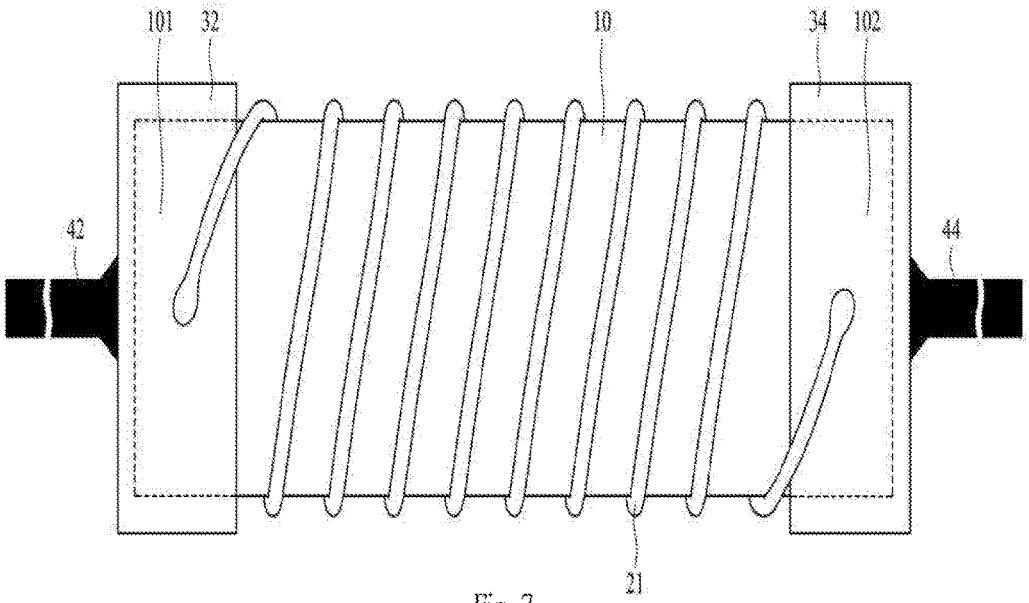
FIGS. 7 to 10 are schematic views showing a method for fabricating a wire- wound fuse resistor in accordance with an embodiment of the present invention.

Please refer to FIGS. 7, 8, 9 and 10. FIGS. 7 to 10 are schematic views showing a method for fabricating a fuse resistor in accordance with an embodiment of the present invention. As shown in FIG. 7, an insulating rod 10 was provided. The insulating rod 10 had a first end 101 and a second end 102. Subsequently, the insulating rod 10 was wound by the metal wire 21. In some embodiments, a first cap 32 and a second cap 34 were formed at two sides of the insulating rod 10, and a first conductive line 42 and a second conductive line 44 were formed at outer sides of the first cap 32 and the second cap 34 to extend outwardly. In some embodiments, two ends of the metal wire 21 were welded on the first cap 32 and the second cap 34 by welding. For example, one end of the wire 21 were welded on the first cap 32 first, then the insulating rod 10 was wound by the metal wire 21, and the other end of the metal wire 21 was welded on the second cap 34.

Figure 8:
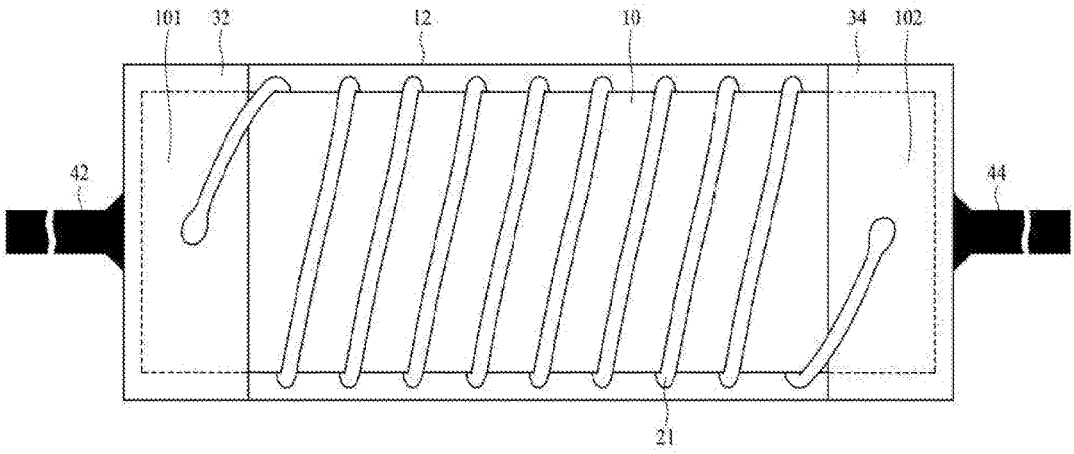
Figure 9:
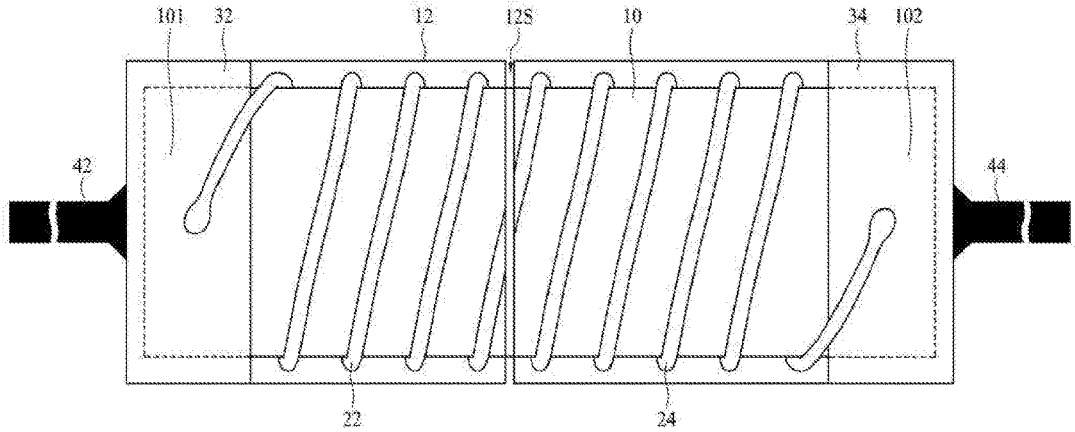
Figure 10:
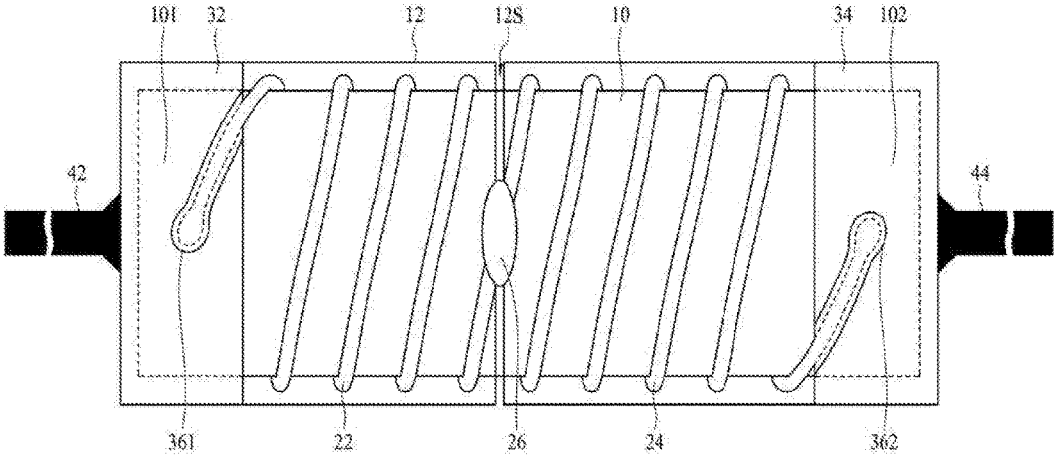

As shown in FIG. 8, a first insulating layer 12 was formed on the insulating rod 10 and the metal wire 21. As shown in FIG. 9, subsequently, an opening 12S was formed in the first insulating layer 12, and the metal wire 21 was cut off, so as to form a first winding wire 22 and a second winding wire 24 separated from each other. In some embodiments, the opening 12S of the first insulating layer 12 was a slot opening, which surrounded the insulating rod 10 and partially exposed the insulating rod 10. In some embodiments, the formation of the slot opening of the first insulating layer 12 and the cutting of the metal wire 21 were implemented simultaneously. In some embodiments, for example, a cutting tool was used for forming the slot opening in the first insulating layer 12 and cutting off the metal wire 21. As shown in FIG. 10, a connection part 26 was formed for electrically connecting the first winding wire 22 to the second winding wire 24. In some embodiments, the connection part 26 was formed by electroplating, being immersed in a tin bath or other suitable processes. In some embodiments, in order to reinforce firmness of the welding points between the first winding wire 22 and the first cap 32 and between the second winding wire 24 and the second cap 34, a first cap electroplated layer 361 was formed for electrically connecting one end of the first winding wire 22 to the first cap 32 (by electroplating, for example), and a second cap electroplated layer 362 was formed for electrically connecting one end of the second winding wire 24 to the second cap 34 (by electroplating, for example), such that the welding firmness was enhanced. As shown in FIG. 6, a second insulating layer 14 was then formed to cover the first insulating layer 12 and the connection part 26 and fill into the opening 12S in the first insulting layer 12, such that a fuse resistor 1 of the present invention was formed.

The wire-wound fuse resistor and the manufacturing method of the present invention are not limited to the above-mentioned embodiments, and may have other different embodiments. To simplify the description and for the convenience of comparison between each of the embodiments of the present disclosure, the identical components in each of the following embodiments are marked with identical numerals. For making it easier to compare the difference between the embodiments, the following description will detail the dissimilarities among different embodiments and the identical features will not be redundantly described.

Figure 11:
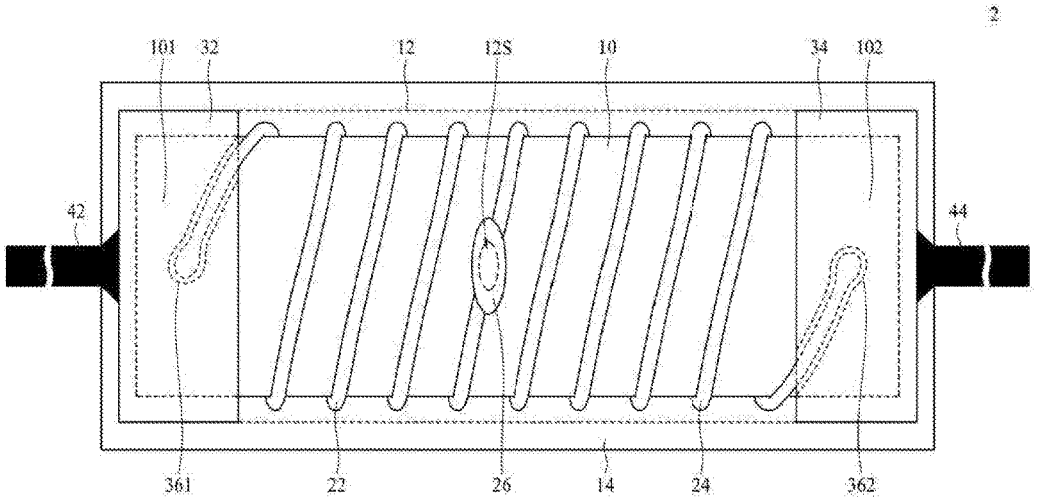
FIG. 11 is a schematic view showing a wire-wound fuse resistor in accordance with another embodiment of the present invention.

Please refer to FIG. 11. FIG. 11 is a schematic view showing a wire-wound fuse resistor in accordance with another embodiment of the present invention. In contrast to the wire-wound fuse resistor 1 of FIG. 1, the opening 12S of the first insulating layer 12 of the wire-wound fuse resistor 2 included a dot opening, which partially exposed the insulating rod 10. In some embodiments, the shape of the dot opening might include any regular or irregular geometric shape. In some embodiments, a width or a diameter of the dot opening of the first insulating layer 12 was between, but not limited to, about 0.05 mm and 2 mm. In the present embodiment, the material of the first insulating layer 12 could include or could be selected from an insulating paint such as an epoxy resin, a silicone non-flammable paint, an enamel paint or other insulating materials. The connection part 26 was in contact with the first winding wire 22 and the second winding wire 24 via the opening 12S of the first insulating layer 12. Furthermore, the second insulating layer 14 covered the first insulating layer 12 and the connection part 26, and filled the opening 12S of the first insulating layer 12. In the present embodiment, the material of the second insulating layer 14 could include or could be selected from an insulating paint such as an epoxy resin, a silicone non-flammable paint, an enamel paint or other insulating materials. The locations, connections, materials and other characteristics of components of the wire-wound fuse resistor 2 such as the insulating rod 10, the first winding wire 22, the second winding wire 24, the connection part 26, the first cap 32, the second cap 34, the first cap electroplated layer 361, the second cap electroplated layer 362, the first conductive line 42 and the second conductive line 44 were similar to that of the fuse resistor 1 of FIG. 1, and thus are not redundantly described.

Figure 12:
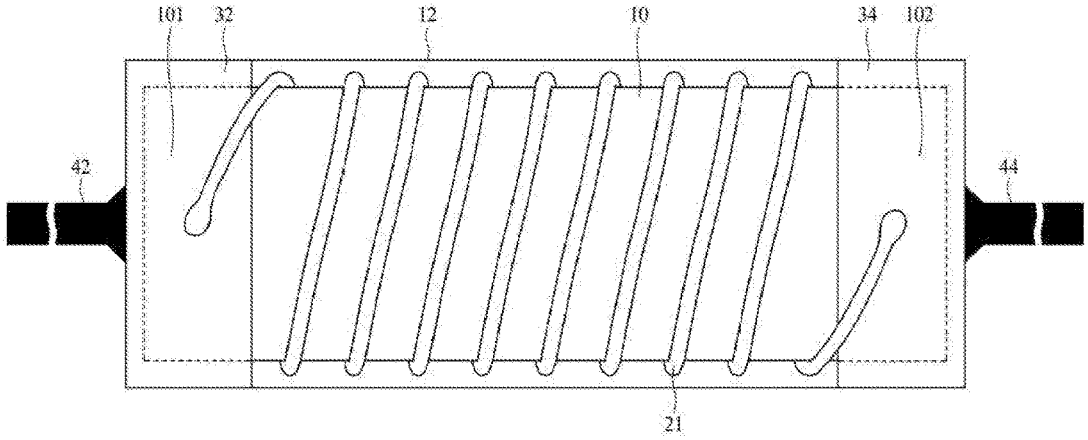
FIGS. 12 to 14 are schematic views showing a method for fabricating a wire-wound fuse resistor in accordance with another embodiment of the present invention.
Figure 13:
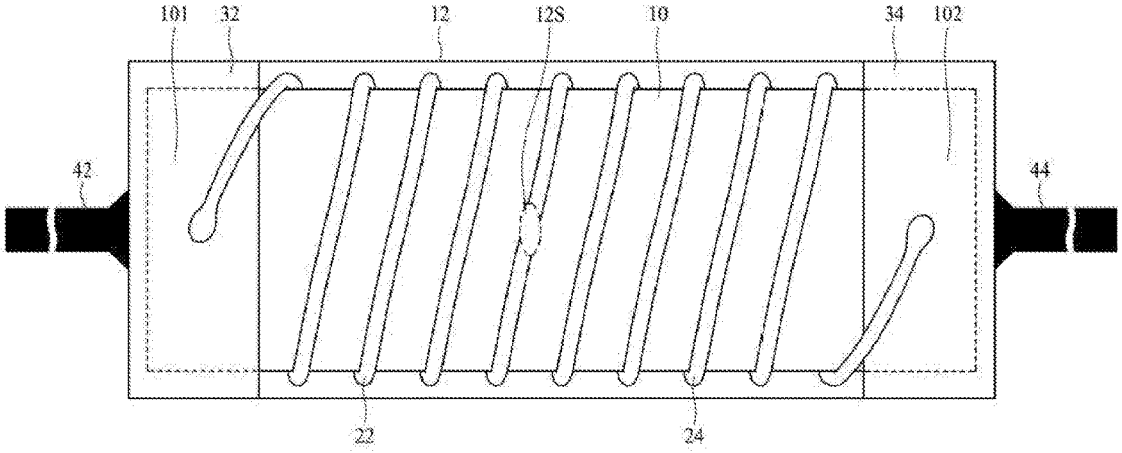
Figure 14:
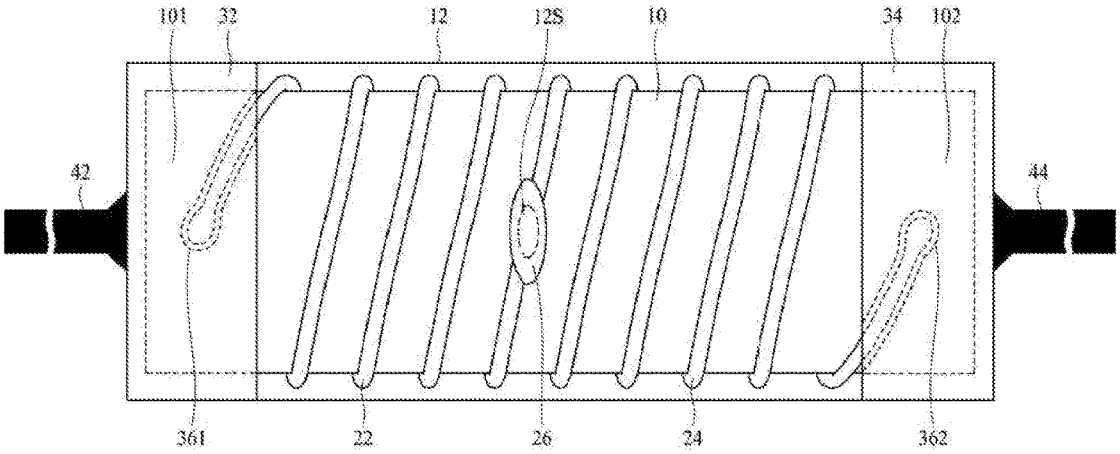

Please refer to FIGS. 12, 13 and 14. FIGS. 12 to 14 are schematic views showing a method for fabricating a fuse resistor in accordance with an embodiment of the present invention. As shown in FIG. 7, an insulating rod 10 was provided. The insulating rod 10 had a first end 101 and a second end 102. Subsequently, the insulating rod 10 was wound by a wire 21. In some embodiments, a first cap 32 and a second cap 34 were formed at two sides of the insulating rod 10, and a first conductive line 42 and a second conductive line 44 were formed at outer sides of the first cap 32 and the second cap 34 to extend outwardly. In some embodiments, two ends of the metal wire 21 were welded on the first cap 32 and the second cap 34 by welding. For example, one end of the metal wire 21 was welded on the first cap 32 first, then the insulating rod 10 was wound by the metal wire 21, and other end of the metal wire 21 was welded on the second cap 34. Subsequently, a first insulating layer 12 is formed on the insulating rod 10 and the metal wire 21.

As shown in FIG. 13, subsequently, an opening 12S was formed in the first insulating layer 12, and the metal wire 21 was cut off, so as to form the first winding wire 22 and the second winding wire 24 separated from each other. In some embodiments, the opening 12S of the first insulating layer 12 was a dot opening, which partially exposed the insulating rod 10. In some embodiments, the formation of the dot opening of the first insulating layer 12 and the cutting of the metal wire 21 were implemented simultaneously. In some embodiments, for example, a cutting tool was used for forming the dot opening in the first insulating layer 12 and cutting off the metal wire 21. As shown in FIG. 9, a connection part 26 was formed in the dot opening for electrically connecting the first winding wire 22 to the second winding wire 24. In some embodiments, the connection part 26 was formed by electroplating, being immersed in a tin bath or other suitable processes. In some embodiments, in order to reinforce firmness of the welding points between the first winding wire 22 and the first cap 32 and between the second winding wire 24 and the second cap 34, the first cap electroplated layer 361 was formed for electrically connecting one end of the first winding wire 22 to the first cap 32 (by electroplating, for example), and a second cap electroplated layer 362 was formed for electrically connecting one end of the second winding wire 24 to the second cap 34 (by electroplating, for example), such that the welding firmness was enhanced. As shown in FIG. 11, a second insulating layer 14 was then formed to cover the first insulating layer 12 and the connection part 26 and filled into the opening 12S in the first insulting layer 12, such that a fuse resistor 2 of the present invention was formed.

In the wire-wound fuse resistor of the present invention, the first winding wire and the second winding wire are connected via the connection part, such that the fusing temperature and the fusing speed of the fuse resistor were well controlled, and the application range and safety of the fuse resistor were improved. In addition, in the fuse resistor of the present invention, the cap electroplated layer was used for reinforcing welding points between the wire and the cap, so as to enhance welding firmness, avoid looseness of wire and reduce production failure. Hence, the fuse resistor of the present invention had the failure rate of surge-resisting welding point lower than 0.1 ppm. In the present invention, the anti-surge effect of the fuse resistor was improved, such that the wire-wound fuse resistor of the present invention can be applied in anti-surge circuits, circuits of a spark plug and an ignition system of a vehicle.

What is claimed is:

1. A wire-wound fuse resistor, comprising:

an insulating rod having a first end and a second end;

a metal wire having a wire head and a wire tail, being helically wound around the insulating rod from the first end to the second end, and being cut at a middle portion thereof to form a first winding wire connecting with the wire head and a second winding wire connecting with the wire tail, wherein the first winding wire and the second winding wire are separated from each other;

a connection part disposed at the cut portion for electrical connection between the first winding wire and the second winding wire, wherein the melting temperature of the connection part is lower than that of the first winding wire and the second winding wire; and a first cap and a second cap respectively disposed to encapsulate the first end and the second end, in which the wire head and the wire tail are respectively soldered onto surfaces of the first cap and the second cap respectively at the first cap and the second cap, and the first cap and the second cap are respectively electroplated with a first cap electroplated layer and a second cap electroplated layer, wherein the first electroplated layer on the first cap, the second electroplated layer on the second cap and the connection part are formed in the same process, and wherein the connection part is cut off depending on a predetermined melting temperature or melting speed of the wire-wound fuse reistor.

2. The wire-wound fuse resistor of claim 1, further comprising a first insulating layer covering the first winding wire and the second winding wire, wherein the first insulating layer has an opening exposing a portion of the insulating rod.

3. The wire-wound fuse resistor of claim 2, wherein a material of the first insulating layer is an epoxy resin, a silicone non-flammable paint or an enamel paint.

4. The wire-wound fuse resistor of claim 2, wherein the opening includes a slot opening surrounding the insulating rod and partially exposing the insulating rod.

5. The wire-wound fuse resistor of claim 2, wherein the opening includes a dot opening partially exposing the insulating rod.

6. The wire-wound fuse resistor of claim 2, wherein the connection part is in contact with the first winding wire and the second winding wire through the opening of the first insulating layer.

7. The wire-wound fuse resistor of claim 6, further comprising a second insulating layer covering the first insulating layer and the connection part, and filling into the opening of the first insulating layer.

8. The wire-wound fuse resistor of claim 7, wherein a material of the second insulating layer is an epoxy resin, a silicone non-flammable paint or an enamel paint.

9. The wire-wound fuse resistor of claim 1, wherein a material of the first cap electroplated layer and the second cap electroplated layer respectively is tin, copper, iron, silver or an alloy thereof.

10. The wire-wound fuse resistor of claim 1, wherein the thicknesses of the first cap electroplated layer and the second cap electroplated layer are between 1 micrometer and 20 micrometers, respectively.

11. The wire-wound fuse resistor of claim 1, which has a gap between the first winding wire and the second winding wire.

12. A method for fabricating a wire-wound fuse resistor, comprising:

providing an insulating rod having a first end and a second end;

winding a metal wire on the insulating rod;

cutting off the metal wire to form a first winding wire and a second winding wire separated from each other;

forming a connection part for electrically connecting the first winding wire to the second winding wire, wherein the melting point of the connection part is lower than that of the first winding wire and the second winding wire;

encapsulating a first cap on the first end of the insulating rod, and encapsulating a second cap on the second end of the insulating rod;

electrically welding the first end of the metal wire on the first cap, and electrically welding the second end of the metal wire on the second cap; and electrically plating a first electroplated layer on the first cap which is welded by the first end of the metal wire thereon, and electrically plating a second electroplated layer on the second cap which is welded by the second end of the metal wire thereon, wherein the first electroplated layer, the second electroplated layer and the connection part are formed together by a process.

13. The method of claim 12, further comprising:

forming a first insulating layer on the insulating rod and the metal wire before cutting off the metal wire; and forming an opening in the first insulating layer and cutting off the wire.

14. The method of claim 13, wherein the opening includes a slot opening surrounding the insulating rod and partially exposing the insulating rod.

15. The method of claim 13, wherein the opening includes a dot opening partially exposing the insulating rod.

16. The method of claim 13, further comprising: forming a second insulating layer for covering the first insulating layer and the connection part and filling into the opening of the first insulating layer.

* * * * *